US009501007B2

(12) United States Patent
Uekawa et al.

(10) Patent No.: US 9,501,007 B2
(45) Date of Patent: Nov. 22, 2016

(54) IMAGE FORMING APPARATUS

(71) Applicant: CANON KABUSHIKI KAISHA, Tokyo (JP)

(72) Inventors: Eiji Uekawa, Susono (JP); Hiroshi Kataoka, Suntou-gun (JP); Keisuke Mochizuki, Suntou-gun (JP); Naoto Tsuchihashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/008,310

(22) Filed: Jan. 27, 2016

(65) Prior Publication Data

US 2016/0223959 A1 Aug. 4, 2016

(30) Foreign Application Priority Data

Jan. 29, 2015 (JP) ..... 2015-015748

(51) Int. Cl.
*G03G 15/20* (2006.01)

(52) U.S. Cl.
CPC ..... *G03G 15/2039* (2013.01)

(58) Field of Classification Search
CPC ..... G03G 15/2028; G03G 15/2039
USPC ..... 399/67, 68
See application file for complete search history.

(56) References Cited

U.S. PATENT DOCUMENTS 6,915,099 B2 * 7/2005 Izawa et al. ..... G03G 15/2064 399/67
9,223,267 B2 * 12/2015 Kawajiri ..... G03G 15/55

FOREIGN PATENT DOCUMENTS

JP 9-80946 A 3/1997
JP 2001-092328 A 4/2001
JP 2004-085978 A 3/2004

* cited by examiner

*Primary Examiner* — William J Royer
(74) *Attorney, Agent, or Firm* — Canon USA, Inc. I.P. Division

(57) ABSTRACT

An image forming apparatus for forming a toner image on a recording material has an image forming unit configured to form the toner image on the recording material; a fixing unit configured to fix the toner image on the recording material while heating and conveying the recording material bearing the toner image at a nip portion, the fixing unit including a heating rotation member and a roller forming the nip portion with the heating rotation member; and a voltage applying unit configured to apply a potential difference between a surface of the heating rotation member and a surface of the roller, wherein a plurality of print modes different in conveyance speed of the recording material at the nip portion are carried out, and wherein the voltage applying unit applies the potential difference smaller in a first print mode than the potential difference in a second print mode.

6 Claims, 11 Drawing Sheets

IMAGE FORMING APPARATUS

BACKGROUND OF THE INVENTION

Field of the Invention

The present invention relates to an image forming apparatus which employs an electrophotographic system, such as a copying machine and an LBP, and has a fixing apparatus for heat fixing a toner image formed on a recording material.

Description of the Related Art

As a fixing apparatus provided in electrophotographic copying machines and printers, a device employing a heating roller and a device employing a film are known. In any fixing apparatus, when unfixed toner on a recording material partially adheres to the surface of a fixing roller or a film, and then a portion to which the toner adheres contacts a recording material next, an image defect referred to as "offset" in which the toner moves to the side of the recording material occurs in some cases. In order to suppress the offset, a configuration of increasing electrostatic adhesion to a recording material of toner is known. Japanese Patent Laid-Open No. 9-80946 discloses performing control so that toner is easily electrostatically held on a recording material by applying a voltage having the same polarity as that of the toner to a base material portion of a fixing film.

Known as a conspicuous image defect among some types of electrostatic offset is separating offset. The separating offset occurs due to remaining of a locally charged portion having a polarity opposite to the polarity of toner caused by strong separating discharge occurring between a fixing nip portion and the surface of a fixing film when a back end portion of the recording material passes through the fixing nip portion in the case where the recording material has a high resistance value.

Although the separating offset can be suppressed by applying a voltage in a direction in which a separating offset electric field is canceled, i.e., a voltage in a direction in which the electrostatic adhesion to a recording material of toner increases, the following conditions arise.

The conditions are as follows. When a large amount of paper dust containing calcium carbonate as the main component is contained in a recording material, the paper dust has a property of easily being positively charged. Therefore, when a voltage to be applied to a pressure roller is large, the positively charged paper dust is easily adsorbed to the side of a fixing film. The paper dust adsorbed to the side of the fixing film is gradually accumulated. When the accumulation amount increases, the release performance of fluororesin of the surface of the fixing film is reduced. When the release performance decreases, the amount of offset toner adhering to the film also increases, so that "toner fouling" in which the paper dust and the toner are mixed occurs. The toner fouling is sometimes accumulated on the surface of the fixing film, sometimes accumulated on the surface of the pressure roller, or sometimes accumulated on both the surface of the fixing film and the surface of the pressure roller. The accumulation manner is determined by the intrinsic characteristics of an apparatus depending on the balance of release performance between the fixing film and the pressure roller or the characteristics of materials in many cases. In any case, when the accumulation amount of the toner fouling exceeds a fixed amount, an image defect caused by discharge of the toner fouling as a toner residue to the surface of the recording material sometimes occurs.

SUMMARY OF THE INVENTION

According to one of preferable embodiments for carrying out the present invention, an image forming apparatus for forming a toner image on a recording material has an image forming unit configured to form the toner image on the recording material; a fixing unit configured to fix the toner image on the recording material while heating and conveying the recording material bearing the toner image at a nip portion, the fixing unit including a heating rotation member and a roller forming the nip portion with the heating rotation member; and a voltage applying unit configured to apply a potential difference between a surface of the heating rotation member and a surface of the roller in such a manner that electrostatic force in a direction in which the toner is held on the recording material occurs, wherein a plurality of print modes different in conveyance speed of the recording material at the nip portion are carried out, and wherein the voltage applying unit applies the potential difference smaller in a first print mode than the potential difference in a second print mode in which the conveyance speed is lower than the conveyance speed of the first print mode.

Further features of the present invention will become apparent from the following description of preferable embodiments with reference to the attached drawings.

DESCRIPTION OF THE EMBODIMENTS

(1) Example of Image Forming Apparatus

Figure 1:
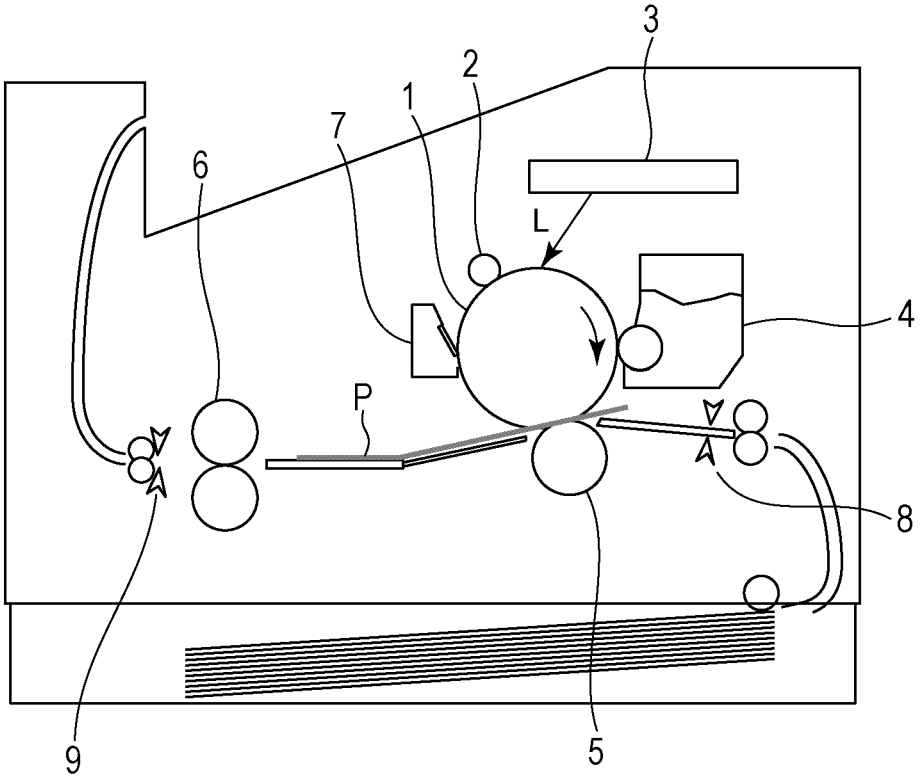
FIG. 1 is a schematic configuration diagram illustrating an image forming apparatus according to the present invention.

FIG. 1 is a schematic configuration diagram of an image forming apparatus having a fixing apparatus representing this example.

The reference numeral 1 denotes a photoconductive drum, in which a photosensitive material, such as OPC, amorphous Se, and amorphous Si, is formed on an aluminum cylinder. The photoconductive drum 1 is rotated and driven in a direction indicated by the arrow. First, the surface is uniformly charged by a charging roller 2 as a charging device. Next, scanning exposure by laser light L in which ON/OFF is controlled according to image information is performed from a laser scanner 3, so that an electrostatic latent image is formed. The electrostatic latent image is developed and visualized by a developing device 4. As a development method, a jumping development method, a two-component development method, and the like are used and image exposure and reversal development are used in combination in many cases.

The visualized toner image is transferred from the photoconductive drum 1 onto a recording material P conveyed at predetermined timing by a transfer roller 5 as a transfer device. Herein, the timing is matched by detecting the front edge of the recording material P by a top sensor 8 in such a manner that the image formation position of the toner image on the photoconductive drum 1 and the writing start position at the front edge of recording material P are in agreement with each other. The recording material P conveyed at predetermined timing is pinched and conveyed under fixed pressure by the photoconductive drum 1 and the transfer roller 5. The recording material P to which the toner image is transferred is conveyed to a fixing apparatus 6 to be fixed as a permanent image. On the other hand, untransferred residual toner remaining on the photoconductive drum 1 is removed from the surface of the photoconductive drum 1 by a cleaning device 7. The reference numeral 9 denotes a sheet discharge sensor provided in the fixing apparatus 6. The sheet discharge sensor 9 is a sensor which detects paper jam and the like, when paper causes the paper jam and the like between the top sensor 8 and the sheet discharge sensor 9.

(2) Fixing Apparatus 6

1) Cross-Sectional Configuration of Fixing Apparatus

Figure 2:
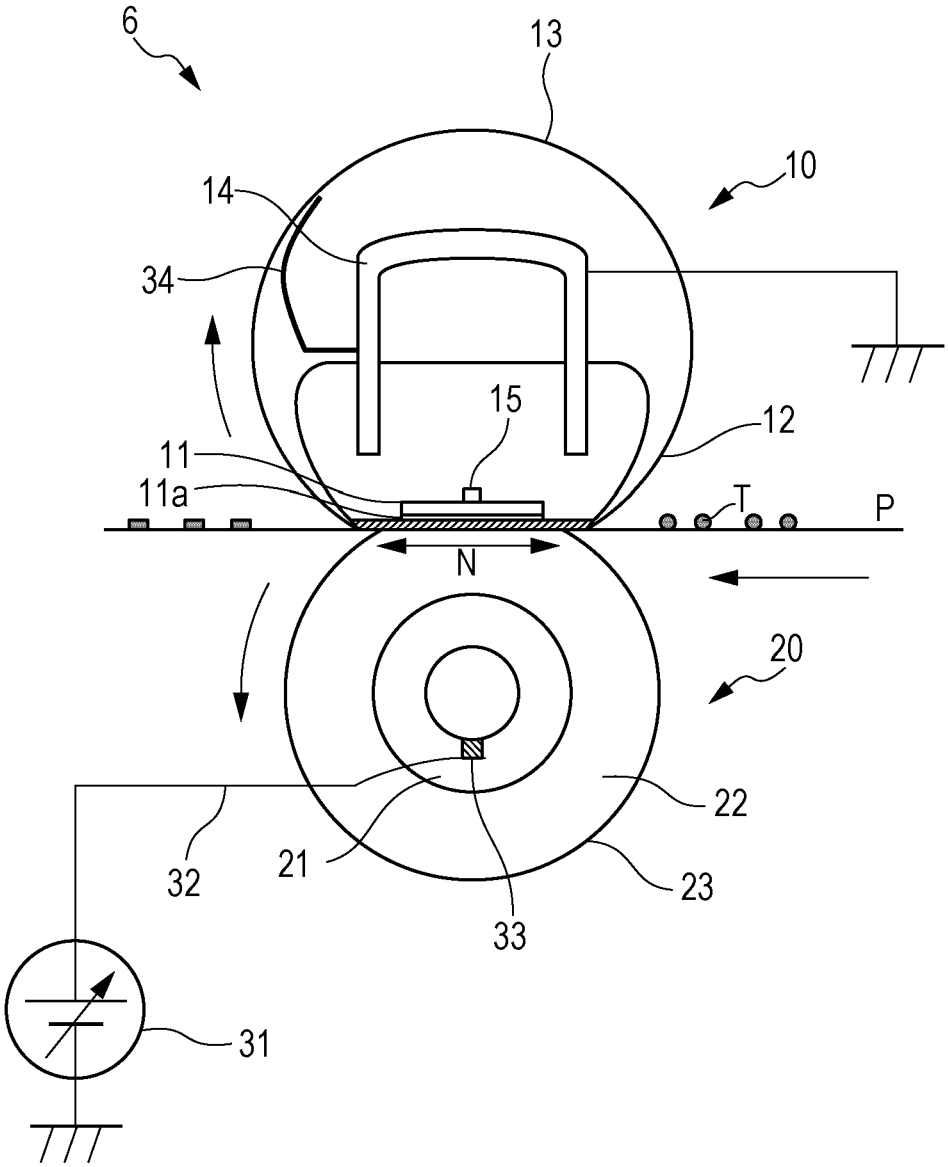
FIG. 2 is a schematic configuration diagram illustrating a heat fixing apparatus according to the present invention.

FIG. 2 is a schematic diagram illustrating the cross-sectional configuration in the central portion in the longitudinal direction of the fixing apparatus 6 representing this example. Hereinafter, it is briefly referred to as a fixing unit. The fixing apparatus 6 has a film unit 10 and a pressure roller 20 which pressure contact each other to form a fixing nip portion N. The film unit 10 has a cylindrical film 13, a heater 11, and a heat insulating holder 12 supporting the heater 11.

The heater 11 heats the fixing nip portion N by contacting the inner surface of the film 13. The heater 11 has a plate shape with a low heat capacity, in which a heating resistor layer of Ag/Pd (silver palladium), $RuO_2$, $Ta_2N$, or the like is formed on the surface of a substrate formed from insulating ceramic, such as alumina and aluminum nitride, along the longitudinal direction by screen printing or the like. On a surface where the heater 11 contacts the film 13, a protective layer 11*a*, such as a glass layer, which protects the heating resistor layer is provided in many cases insofar as the thermal efficiency is not impaired. The heat insulating holder 12 holding the heater 11 is formed from a heat-resistant resin, such as a liquid crystal polymer, phenol resin, PPS, or PEEK, and also has a function of guiding the rotation of the film 13. A metal stay 14 is a member which supports the heat insulating holder 12 over the longitudinal direction in order to increase the bending rigidity of the film unit 10.

The film 13 as a heating rotation member is a heat-resistant film having a total thickness of 200 μm or less in order to enable a quick start. An electrically conductive resin in which electrically conductive fine particles, such as carbon black, are added to a heat resistant resin, such as polyimide, polyamide imide, and PEEK, a pure metal, such as SUS, Al, Ni, Cu, and Zn, having heat resistance and high thermal conductivity, or an electrically conductive metal containing an alloy is used as a base layer. As the thickness of the base layer having sufficient strength for configuring a fixing apparatus having a long-lifetime and having excellent durability, a thickness of 20 μm or more is suitable. Therefore, the thickness of the base layer of the film 13 is optimally 20 μm or more and 200 μm or less. Furthermore, in order to prevent the offset and secure the separation properties of the recording material, the following materials are used for a top layer. Heat-resistant resin having good releasability, such as: fluororesin, such as PTFE (polytetrafluoroethylene), PFA (tetrafluoroethylene perfluoroalkyl vinyl ether copolymer), FEP (tetrafluoroethylene hexafluoro propylene copolymer), ETFE (ethylene tetrafluoroethylene copolymer), CTFE (polychlorotrifluoroethylene), and PVDF (polyvinylidene fluoride); and silicone resin are mentioned. Between the top layer and the base layer, a silicone rubber layer having a thickness of about 100 μm to 300 μm may be formed as an intermediate rubber layer. By forming the intermediate rubber layer, unevenness of the surface of the recording material or unevenness of a toner image and the surface of the film 13 easily follow each other, which makes it possible to provide good fixed image quality.

The pressure roller 20 has a core metal 21, an elastic layer 22 formed on the outside of the core metal 21, and a top layer 23 formed on the outside of the elastic layer 22. The core metal 21 is formed from metal, such as SUS, SUM, and Al. The elastic layer 22 is formed from silicone rubber, fluororubber, sponge rubber, cellular rubber in which hollow fillers (microballoon and the like) are dispersed in silicone rubber, or the like. Electrically conductive particles, such as carbon black, are added to the elastic layer 22, so that conductivity is imparted thereto. The elastic layers may be a monolayer or may be formed by laminating a plurality of layers different in the properties according to the objects, such as thermal conductivity and hardness. The top layer 23 is formed from a tetrafluoroethylene.perfluoroalkyl vinyl ether copolymer resin (PFA), a polytetrafluoroethylene resin (PTFE), or the like. In this example, the image defects, such as electrostatic offset and separating offset, are suppressed by applying a voltage having a polarity opposite to the charge polarity of toner to the core metal 21 of the pressure roller 20. A voltage applying unit is described later.

The pressure roller 20 obtains driving force for rotating in a direction indicated by the arrow of FIG. 2 by a drive gear, which is not illustrated, provided at an end portion of the core metal 21. The driving force is transmitted from a motor, which is not illustrated, according to an instruction from a CPU, which is not illustrated, controlling a control unit. The film 13 rotates following the rotation by frictional force with the pressure roller 20 with the rotation and driving of the pressure roller 20. By inserting a lubricant, such as a fluorine-based or silicone-based heat-resistant grease, between the film 13 and the heater 11, the frictional resistance is kept low, so that the film 13 can smoothly rotate. With respect to temperature control of the heater 11, the CPU determines and appropriately controls the duty ratio, the wave number, and the like of a voltage to be applied to the heating resistor layer according to a signal of a temperature detection sensor 15, such as a thermistor, provided on the back surface of the ceramic substrate, whereby the temperature in the fixing nip is kept at a desired fixing preset temperature.

The recording material P holding an unfixed toner image T is supplied as appropriate at predetermined timing by a supply unit, which is not illustrated, and then conveyed into the fixing nip to be heat fixed. The recording material P discharged from the fixing nip portion is guided to a sheet discharge guide, which is not illustrated, to be discharged.

2) Voltage Applying Unit

The reference numeral 31 of FIG. 2 denotes a voltage power supply which applies a variable voltage to the pressure roller 20. A predetermined voltage is applied according to an instruction from a control circuit unit, which is not illustrated. With respect to the path from the voltage power supply 31, the voltage power supply 31 is electrically connected with a part of the core metal 21 of the pressure roller 20 through a safety circuit and a power supply cable, which are not illustrated, through a power supply unit 33, such as a carbon chip, provided at the front edge of an electrically conductive member 32, such as a plate spring, and then a voltage having a polarity opposite to the polarity of a toner is applied to the core metal 21. The application amount and a control method of the voltage to be applied to the pressure roller 20 are described below.

The film 13 facing the pressure roller 20 is grounded through an electrically conductive member 34 and the metal stay 14 from the electrically conductive base layer on the inner surface of the film 13.

(3) Method for Controlling Voltage to be Applied to Pressure Roller

Cause of Occurrence of Separating Offset

Figure 3A:
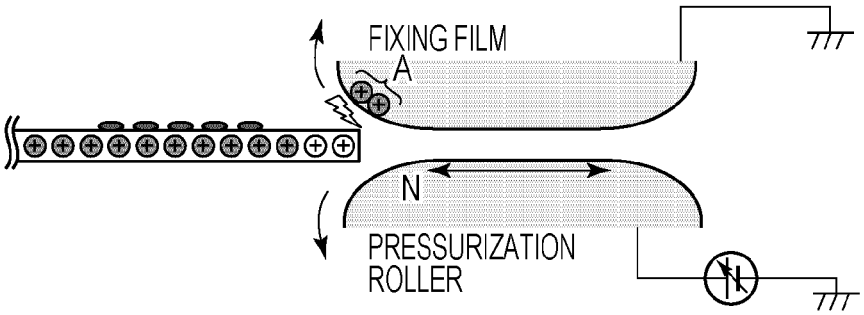
FIGS. 3A to 3D are views explaining an embodiment of the present invention.
Figure 3B:
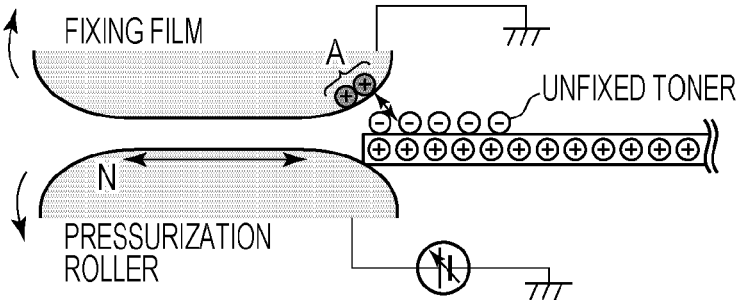
Figure 3C:
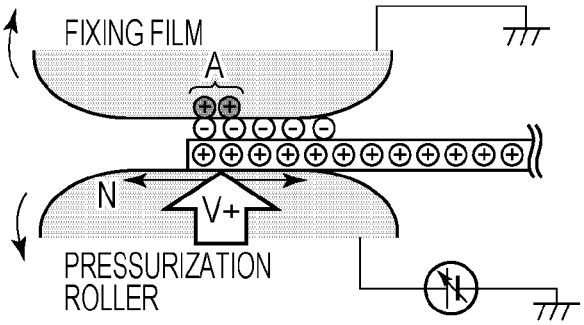

The cause of the separating offset and the effectiveness of the voltage to be applied to the pressurization roller are described with reference to FIGS. 3A to 3D. Herein, a negative toner which is charged to a negative polarity is used. The fixing nip portion N is basically in a contact state but, for an explanation, the film surface and the surface of the pressurization roller are separated in FIGS. 3A to 3D. As illustrated in FIG. 3A, when the back end of the recording material passes through the fixing nip portion N, separating discharge occurs due to positive charges of a back end portion of the recording material and the film surface. When the positive charges held in the recording material herein originate from a positive voltage to be applied to the transfer roller 5 when the unfixed toner image T is transferred onto the recording material. When the separating discharge occurs on the back end portion of the recording material and the film surface, a region A which is locally strongly positively charged is generated in the film surface. When the following recording material is introduced into the fixing nip portion N due to the rotation of the film 13, and then the returning of the positively charged region A to the upstream side of the fixing nip portion N as illustrated in FIG. 3B, the unfixed toner image T which is negatively charged is attracted to the positively charged region A. At this time, by assisting a positive voltage from the pressure roller side as illustrated in FIG. 3C, the toner which is attracted to the positively charged region A of the film surface is likely to be held on the recording material side, so that the separating offset can be prevented. Therefore, when the voltage to be applied to the pressurization roller is higher, the separating offset improvement effect is higher.

Cause of Adsorption of Paper Dust

Figure 3D:
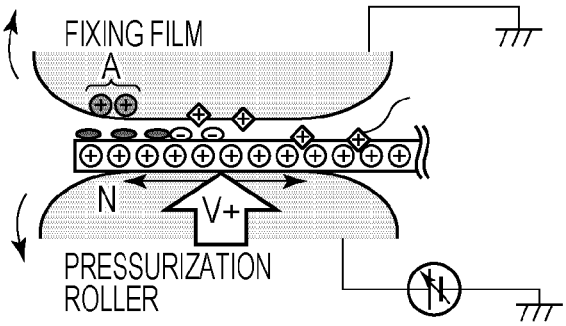

On the other hand, as illustrated in FIG. 3D, since the positively charged paper dust receives electrostatic force repelling the positive voltage applied to the pressurization roller, the positively charged paper dust is likely to adsorbed to the film surface. A reason why the paper dust is positively charged is described later. Therefore, when the applied voltage to the pressurization roller is higher, the accumulation amount of the paper dust further increases.

Influence by Recording Material Type

Herein, the relationship between the type of the recording material to be used by a user and the separating offset or the pressure roller soiling is described.

Recording materials which are heavily used by a large number of users are generally classified into a "plain paper". In the plain paper, the basis weight of the paper is specified to be approximately 64 g/m$^2$ to 90 g/m$^2$ in many cases, and thus the plain paper has relatively smooth surface properties. Herein, paper which has a basis weight of 64 g/m$^2$ or less and is generally classified into a "thin paper" is also collectively treated as the plain paper. When printing is performed by an image forming apparatus, a "plain paper mode" (first print mode) is used. The "plain paper mode" is a mode selected in the initial setting of the image forming apparatus and is a usual use mode which is heavily used by a large number of users. In usual, the print speed in the "plain paper mode" is the maximum speed settable in the device. In order to emphasize clearness of a "test image" which is a general printed sample among image patterns to be printed on the plain paper, a large number of users prefer a plain paper having a high whiteness degree in recent years. In order to increase the whiteness degree of the plain paper, the addition amount of calcium carbonate increases as a pigment for paper. Paper dust containing calcium carbonate as the main component has a property of being easily positively charged due to rubbing against other members. For example, due to rubbing against a fluororesin member for use in the film and the top layer of the pressure roller, the fluororesin is likely to be negatively charged and the paper dust is likely to be positively charged. When the plain paper having a large amount of such paper dust is continuously used in the configuration in which a positive voltage is applied to the pressure roller, the paper dust soiling is likely to be accumulated on the film or the pressure roller. Therefore, it is desirable that the positive voltage to be applied to the pressure roller is controlled to be low as much as possible in the plain paper mode.

On the other hand, the basis weight of paper classified into a "thick paper" is generally 100 g/m$^2$ to 250 g/m$^2$. Moreover, there is paper classified into a "rough paper" as paper having a basis weight of 75 g/m$^2$ to 90 g/m$^2$, which is close to the plain paper, but having rough surface properties as compared with the surface properties of the plain paper (low smoothness). Furthermore, there is paper classified into a "glossy paper (gloss paper)" as paper which is one type of thick paper and can emphasize particularly the glossiness of a color image. These paper types are collectively referred to as a "special paper" herein. When printing is performed by an image forming apparatus, a "special paper mode" (second print mode) is used. The "special paper mode" is further divided into a plurality of modes according to the characteristics of the thick paper, the rough paper, the glossy paper, and the like in some cases. The "special paper" has a higher resistance value under the influence of the paper thickness as compared with the plain paper and also has a higher transfer voltage value in a transfer process of transferring a toner image to a recording material in an image forming apparatus. More specifically, the number of positive charges held in the recording material is larger than the number of positive charges of the plain paper.

Therefore, the separating discharge amount when the recording material back end passes through the fixing nip portion is large, and the voltage of the pressure roller as a measure against the separating offset is desirably higher. On the other hand, the proportion of the calcium carbonate used as a pigment is low and the accumulation amount of the paper dust on the film or the surface of the pressure roller is also small as compared with those of the plain paper. Furthermore, since the special paper is thick, a large amount of thermal energy is required for fixing toner as compared with the plain paper.

Also in the rough paper having a small basis weight, since the transferability is inferior to the plain paper owing to the unevenness properties of the paper surface, the transfer voltage value is high. Therefore, as the measure against the separating offset, it is necessary to apply a high voltage value to the pressure roller also in the rough paper similarly to the case of the thick paper. Moreover, also in heat fixing, since the adhesiveness with the film surface is poor, it is necessary to give a larger amount of thermal energy than the amount of thermal energy to the plain paper.

Voltage Control Method of this Embodiment

In consideration of the characteristics of the paper described above, the voltage control is performed according to the following relationship as an embodiment in the present invention.

The voltage to be applied to the pressure roller when printing is performed in the "plain paper mode" is defined as "Vn (volt)" and the conveyance speed of a recording material in the plain paper mode is defined as "Mn (mm/sec)". The voltage to be applied to the pressure roller when printing is performed in the "special paper mode" is defined as "Vs (volt)" and the conveyance speed of a recording material in the special paper mode is defined as "Ms (mm/sec)". In this case, Vn, Mn, Vs, and Ms establish the following relationship.

Voltage to pressure roller (volt):Vn (plain paper)<Vs (special paper)

Conveyance speed of recording material (mm/sec):Mn (plain paper)>Ms (special paper)

More specifically, in the "plain paper mode" in which the amount of paper dust is relatively large and the pressure roller soiling is likely to be caused, the voltage to be applied to the pressure roller is reduced and the drawing amount of the paper dust is suppressed as much as possible. A reason why the separating offset does not cause a problem even when the voltage value is reduced in the plain paper mode in this case is described below from the viewpoint of the conveyance speed of the recording material.

Figure 4:
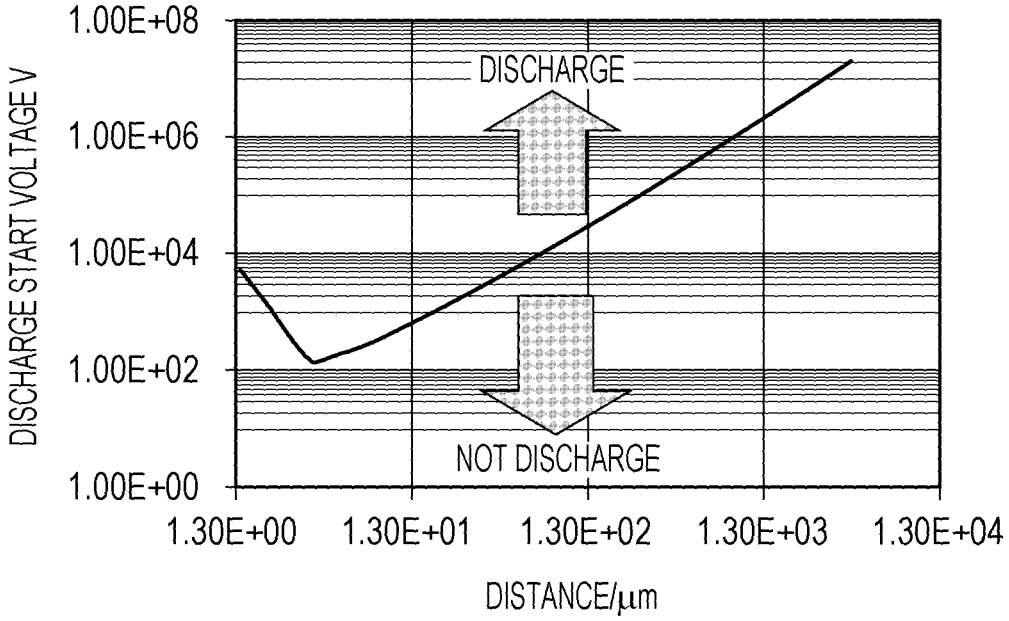
FIG. 4 is a view explaining an embodiment of the present invention.

As described with reference to FIG. 3A, the separating offset occurs when the charges in the recording material back end cause separating discharge to the film. The ease of the occurrence of the separating discharge (discharge start voltage) depends on the distance (gap) between the recording material back end and the film according to the Paschen's law shown in FIG. 4. In the case of a distance of about 10 μm, the separating discharge occurs at a potential difference of approximately several hundred V and the film side is charged.

Figure 5A:
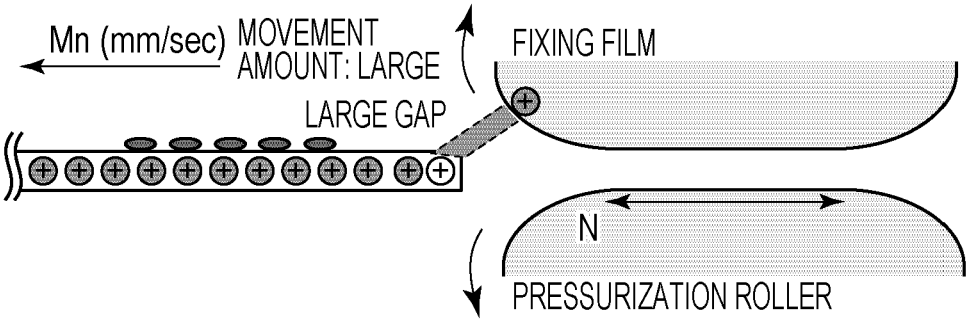
FIGS. 5A and 5B are views explaining an embodiment of the present invention.
Figure 5B:
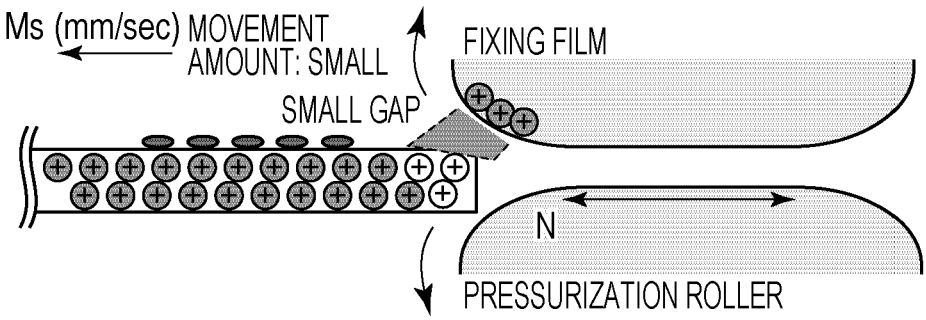

FIGS. 5A and 5B illustrate the state of a gap between the recording material back end and the film when time t (msec) has passed after the recording material back end is discharged from the downstream of the nip in each of the plain paper mode and the special paper mode. In the "plain paper mode" in which the conveyance speed of the recording material is high, the speed at which the back end goes away from the downstream of the fixing nip is high, so that the gap is immediately widened as illustrated in FIG. 5A. Therefore, the period of time while the separating discharge occurs is also short and the number of positive charges held in the recording material is also small, so that the separating discharge amount is small and the separating charge amount remaining on the film surface is small (In FIG. 5A, a discharge area indicated by the dotted lines is narrow). On the other hand, in the special paper mode illustrated in FIG. 5B in which the conveyance speed of the recording material is low, the speed at which the back end goes away from the downstream of the fixing nip is low, and thus the gap is not widened. Therefore, the period of time while the separating discharge occurs is also long and the number of positive charges held in the recording material due to the reception of a high transfer voltage for a long time is also large, so that the separating discharge amount is large and the separating charge amount remaining on the film surface increases (In FIG. 5B, a discharge area indicated by the dotted lines is wide).

A method for suppressing the separating discharge by performing printing in the "special paper mode" at the same conveyance speed of the recording material as that of the "plain paper mode" is also considered but, as described above, the recording material classified into the special paper requires a larger quantity of heat than that in the plain paper in toner fixing. In order to supply a larger quantity of heat, a measure of increasing the regulated temperature is also considered. However, the measure is not desirable because the measure has concerns of problems occurring when the regulated temperature is set to be high, e.g., curling and degradation of stacking properties of paper, degradation of fixed image quality, an increase in the generation amount of vapor from paper, and the like.

Hereinafter, the results obtained by evaluating Examples 1 to 5 in which the voltage control of this embodiment was applied for the separating offset and the toner fouling are described.

(4) Comparison of Effects

In the evaluation described below, the types of the used recording materials are as follows.

As the plain paper, Red Label manufactured by Oce having a basis weight of about 80 g/m$^2$ was used. As the special paper, Hammer Mill manufactured by International Paper which was a thick paper having a basis weight of 120 g/m$^2$ was used.

As an image forming apparatus used for the evaluation, a LBP (laser beam printer) was used and the configuration was altered as appropriate according to Examples described below.

Evaluation of Separating Offset

A halftone image pattern was continuously formed on 50 sheets of each of plain paper and special paper which were individually allowed to stand in an environment of a low temperature and a low humidity (15° C./10% RH), and then separating offset was evaluated. As toner used in this evaluation, the evaluation was performed using a negative toner having a characteristic of being charged to a negative polarity. The evaluation results were classified as follows.

◎: Separating offset did not occur at all.

○: Separating offset very slightly and partially occurred and was recognized when carefully observed.

Δ: Separating offset slightly and partially occurred.

x: Separating offset occurred in the shape of streaks in the longitudinal direction.

Evaluation of Toner Fouling

For the evaluation of toner fouling, 10,000 sheets of each of plain paper and special paper were passed in a print mode of repeating a cycle of continuously passing 4 sheets, and then stopping for 5 minutes in an environment of a low temperature and a low humidity (15° C./10% RH), and then the soiling of the pressure roller was evaluated. The evaluation results were classified as follows.

◎: Soiling did not occur at all.

○: Very slight soiling occurred in the pressure roller but did not adhere onto paper.

Δ: Slight soiling occurred in the pressure roller and sometimes adhered onto paper.

x: Soiling of the pressure roller was noticeable and noticeable soiling adhered also onto paper.

Examples described below were subjected to the evaluation described above.

Example 1

The details of the specification of a product described in this example are described below.

The conveyance speed of a recording material in the "plain paper mode" in an image forming apparatus is 220 mm/sec, and 40 sheets of A4 size paper can be printed in 1 minute in vertical feeding. The film 13, the pressure roller 20, and the like contacting paper rotate at approximately the same peripheral speed as the conveyance speed of the recording material. The conveyance speed of the recording material in the "special paper mode" is half the conveyance speed in the plain paper mode, and is 110 mm/sec.

The outer diameter of the film 13 is 18 mm. The base layer is formed from a 70 μm thick PI (polyimide). Carbon black is added to the base layer and the base layer is electrically conductive as electrical characteristics. A 200 μm thick silicone rubber layer is provided as an elastic layer thereon. As the top layer, fluororesin (PFA) molded into a tubular shape having a thickness of 25 μm covers the film 13. The PFA of the top layer has insulation properties.

The outer diameter of the pressure roller 20 is 22 mm. The core metal is formed from iron and has an outer dimension of 14 mm. On the core metal, an electrically conductive solid silicone rubber layer having a thickness of about 4.0 mm is formed as an elastic layer. Furthermore, as the top layer, a 50 μm thick PFA tube covers the pressure roller 20. The PFA of the top layer has insulation properties. In the pressure roller 20, the hardness of the silicone rubber was adjusted in such a manner that the hardness measured when an Asker C hardness meter was brought into contact with the surface at a 1 kg load was 55°.

The contact pressure of the pressure roller 20 and the film 13 and the heat insulating holder 12 is 215 N.

In the configuration of Example 1, the results obtained by evaluating the separating offset and the toner fouling by varying the voltage value to be applied to the pressure roller 20 are shown in Table 1. The results are obtained by performing the evaluation for both the plain paper and the special paper.

Table 1 shows, as comparative examples, Comparative Example 1 and Comparative Example 2 about the case where the voltage value is not varied depending on the sheet passing mode. In Comparative Example 1, a high voltage value=1200 V is applied irrespective of the mode with emphasis on the separating offset but, as an adverse effect, the pressure roller soiling of a plain paper is worsened. In Comparative Example 2, a low voltage value=400 V is applied irrespective of the mode in order to prevent the pressure roller soiling but the evaluation result of the separating offset when a special paper is used is bad.

On the other hand, in this example, both the prevention of the separating offset and the prevention of the pressure roller soiling can be achieved by selecting a low voltage value=400 V in the plain paper mode and selecting a high voltage value=1200 V in the special paper mode.

The technical idea of this example is not limited to the setting of the voltage in the plain paper mode and the special paper mode. The following setting is performed in the image forming apparatus capable of carrying out a plurality of print modes different in the conveyance speed of a recording material in the fixing nip portion. The setting is performed in such a manner that the voltage value in the first print mode is smaller than the voltage value in the second print mode in which the conveyance speed is lower than that of the first print mode. Thus, both the prevention of the separating offset and the prevention of the pressure roller soiling can be achieved.

Example 2

In Example 2, the basic configuration is the same as that of Example 1, and a PFA tube having low charge characteristics described later is used for the PFA tube used for the top layer of the pressure roller.

The PFA tube having low charge characteristics is a fluororesin tube in which a PFA (tetrafluoroethylene perfluoroalkyl vinyl ether copolymer) which is a fluororesin contains at least one type of polymer selected from polyvinylidene fluoride (PVDF), polyacryl nitrile (PAN), and polymethyl methacrylate (PMMA) and a monomer electro-

TABLE 1

Relationship between peeling offset and pressure roller soiling depending on applied voltage value to pressure roller

| | Plain paper mode (Full speed = 200 mm/sec) | | | Special paper mode (Half speed = 110 mm/sec) | | |
|---|---|---|---|---|---|---|
| | Voltage (V) to pressure roller | Peeling offset | Pressure roller soiling | Voltage (V) to pressure roller | Peeling offset | Pressure roller soiling |
| | 300 | Δ | ⊙ | 300 | X | ⊙ |
| ← Comparative Example 2 | 400 | ○ | ○ | 400 | X | ⊙ |
| | 500 | ⊙ | Δ | 500 | X | ⊙ |
| | 600 | ⊙ | X | 600 | X | ⊙ |
| | 700 | ⊙ | X | 700 | X | ⊙ |
| | 800 | ⊙ | X | 800 | Δ | ⊙ |
| | 900 | ⊙ | X | 900 | Δ | ⊙ |
| | 1000 | ⊙ | X | 1000 | ○ | ⊙ |
| | 1100 | ⊙ | X | 1100 | ○ | ○ |
| Comparative Example 1 → | 1200 | ⊙ | X | 1200 | ⊙ | ○ |

lyte, such as a fluorine-based surfactant. A typical material of the fluorine-based surfactant is selected from fluoroalkylsulphonate derivatives, such as sulfonic acid, disulfonic acid, sulfonimide, and sulfonamide. As examples, trifluoromethanesulfonate lithium and the like are mentioned. The addition amount of these polymers and the monomers each to the fluororesin is desirably 0.05 part or more and 5 parts or less based on 100 parts of the fluororesin. When the addition amount is 0.05 part or less, effective charge characteristics are not obtained. When the addition amount is 5 parts or more, the processability deteriorates.

By the use of the PFA tube having such a material configuration, even when the recording material is subjected to separating charge when passing through the fixing nip portion, effects that the charges promptly attenuate and the separating offset is suppressed are easily obtained. When only the monomer electrolyte is blended, the triboelectric charge characteristics against paper improve but an effect of attenuating the separating charges on the film side is low. By adding the polymer thereto, the degree of movement of ions in the polymer can be increased, so that an effect of promoting the attenuation of the separating charges is obtained.

The comparison results of Example 2 are shown in Table 2. In Table 2, the comparison results of Examples 1 to 5 are collectively shown. In Table 2, the preset value of a voltage at which both the prevention of the separating offset and the prevention of the toner fouling can be achieved and the occurrence level at each preset value in the plain paper mode and the special paper mode in each Example are collectively shown.

As is clear from the results of Table 2, the level of the separating offset of the plain paper at the same applied voltage is better in Example 2 than in Example 1. The effect of the present invention can be further increased by the use of the PFA tube having low charge characteristics for the pressure roller top layer described above.

Example 3

The details of the configuration for explaining Example 3 are as follows.

Example 3 is an example in which the tube having low charge characteristics for the top layer of the pressure roller was used in Example 2 was also applied to a tube of the top layer of the film. The configuration of materials is the same as that of Example 2, and therefore the description is omitted. In this example, since the PFA tube having low charge characteristics is used on the film side which is charged with positive charges by separating discharge, the charge attenuation of the separating charge can be more effectively increased. As a result, a value of the voltage to be applied to the pressure roller required for preventing the separating offset can be reduced. The level of pressure roller soiling is also improved.

Example 4

Figure 6:
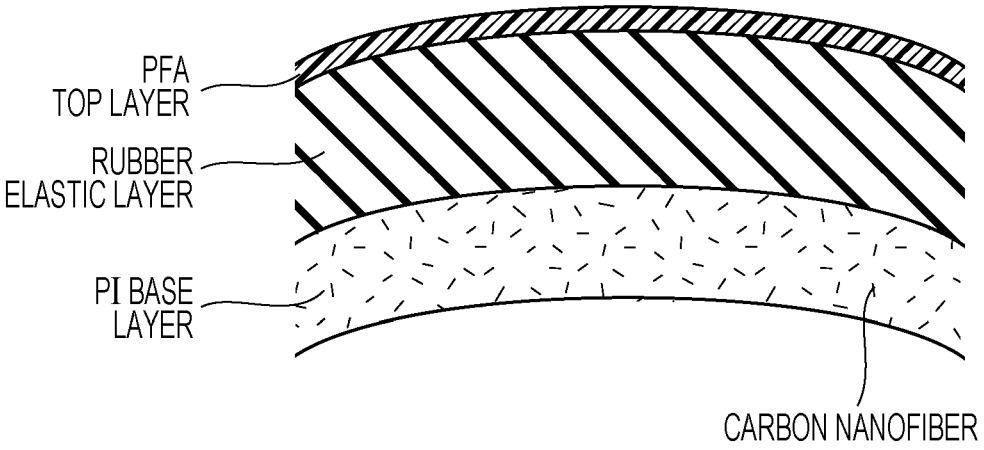
FIG. 6 is a view explaining Example 4 of the present invention.

In Example 4, carbon fiber materials and carbon nanomaterials are dispersed in the base layer of the film and the elastic layer of the pressure roller in the configuration of Example 2. As examples of the carbon fiber materials or the carbon nanomaterials, materials, such as carbon fibers, carbon nanofibers, carbon nanotubes, and carbon microcoils, can be selected. First, with respect to the base layer of the film, carbon nanofibers having thermal conductivity of 300 W/m-K or more is added to a base material, such as polyimide. Carbon nanofibers having a fiber diameter in the range of 50 nm to 500 nm on average and a fiber length in the range of 10 μm to 200 μm on average are desirable. As the addition amount, a compounding ratio of 10 to 60 parts based on 100 parts of polyimide resin is desirable. The electric resistivity of the base layer varies according to the compounding ratio and the base layer desirably has electrical conductivity of $10^8$ Ω·m or less. In this example, the electric resistivity is set to $10^6$ Ω·m or less. By the addition of the carbon nanofibers, in addition to the fact that the thermal conductivity of the base layer improves, an effect of eliminating the charges on the surface of the film increases due to the effect of the fibers present on the interface between the base layer and the elastic layer in the cross-sectional configuration of the film as illustrated in FIG. 6. Due to the increase in the charge eliminating effect, the elimination of triboelectric charges due to rubbing against paper and the separating charge amount when paper passes through the fixing nip portion can be suppressed.

Figure 7:
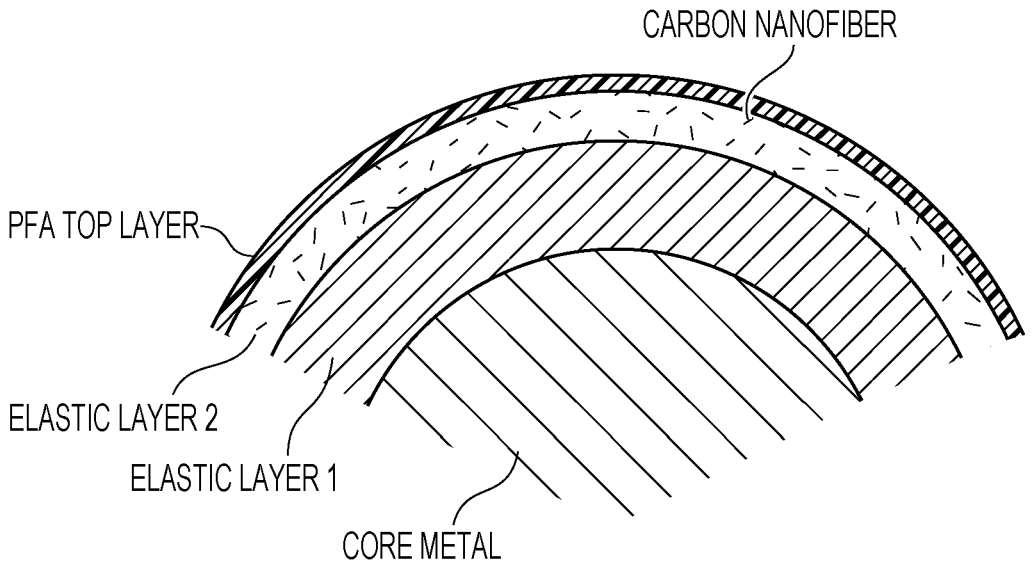
FIG. 7 is a view explaining Example 4 of the present invention.

The same effects can be obtained also in the elastic layer of the pressure roller. In this example, the elastic layer was divided into two layers of a 3 mm thick elastic layer 1 and a 1 mm thick elastic layer 2 from the core metal side. In the elastic layer 1, electrically conductive silicone rubber having electrical conductivity was added and, in the elastic layer 2, carbon nanomaterials were added. A configuration may be acceptable in which only one elastic layer is molded as the elastic layer, and then the materials are added to the entire layer. Examples of the carbon fiber materials or the carbon nanomaterials to be added are the same as those mentioned above. As suitable carbon fibers to be added to the silicone rubber of the elastic layer 2, carbon fibers having thermal conductivity of 300 W/m·K or more, a fiber diameter in the range of 1 μm to 20 μm on average, and a fiber length in the range of 10 μm to 300 μm on average are desirable. As the addition amount, a compounding ratio of 10 parts to 60 parts based on 100 parts of silicone rubber is desirable. In this example, carbon fibers having thermal conductivity of 600 W/m·K is compounded in a proportion of about 50 parts. The following effects are obtained by adding the carbon fibers to the elastic layer 2. In addition to the fact that the thermal conductivity of the elastic layer 2 improves, an effect of eliminating the charges on the surface of the pressure roller and the surface of the film increases due to the effects of the carbon fibers present on the interface between the elastic layer 2 and the top layer in the cross-sectional configuration of a pressure roller as illustrated in FIG. 7. Due to the increase in the charge eliminating effect, the elimination of the triboelectric charge due to rubbing against paper and the amount of separating charge on the film can be suppressed.

The evaluation results of the separating offset and the toner fouling using the configuration of Example 4 show that the separating offset can be suppressed even when the applied voltage to the pressure roller in the plain paper mode is set to be the lowest as shown in Table 2. Moreover, due to the fact that the applied voltage can be set to be low, the toner fouling level of the pressure roller is also good.

In this example, the carbon fibers and the carbon nanomaterials were added to both the base layer of the film and the elastic layer 2 of the pressure roller but a configuration may be acceptable in which the carbon fibers and the carbon nanomaterials are added only to either the base layer of the film or the elastic layer 2 of the pressure roller. The carbon fibers and the carbon nanomaterials can also be added to a layer other than the base layer of the film and the elastic layer of the pressure roller, e.g., the rubber elastic layer and the top layer of the film, the top layer of the pressure roller, or a primer material when each layer is stuck to each other using a primer.

Example 5

The details of the configuration for explaining Example 5 are as follows.

In Examples 1 to 4, the configuration of the heat fixing unit of applying a voltage to the pressure roller is described. Example 5 has a configuration of applying a voltage having a polarity opposite to the polarity of toner to the film. Even in the configuration of applying a voltage to the film side, the same effects as those of Examples 1 to 4 can be expected. In the configuration of applying a voltage to the film, a voltage can be supplied from the inner surface of the film through a power supply unit to the electrically conductive base layer of the film, for example. Or, a configuration can be employed in which the electrically conductive base layer is exposed in an end potion in the longitudinal direction of the film, and electric power is supplied through an electrically conductive brush or the like in the exposed portion in the end portion. Or, when a heat resistant resin having insulation properties is used for the base layer of the film, a configuration can be employed in which an electrically conductive primer layer or the like is provided between the base layer and the top layer, the electrically conductive primer layer is exposed to a film end portion, and electric power is supplied by a method for bringing a power supply brush into contact with the exposed portion.

In Example 5, the effects were confirmed in the case where a voltage is applied to the electrically conductive film base layer portion from the inner surface with respect to the configuration of Example 1. Since the used toner is a negative toner which is charged to a negative polarity, a negative voltage is applied to the film base layer. The pressure roller is configured to be grounded through a core metal portion.

As is clear from Table 2, even when a voltage is applied to the film, the voltage value required for suppressing the separating offset can be more sharply reduced in the plain paper mode than in the special paper mode, so that the toner fouling can be improved to a satisfactory level.

In this example, a voltage was applied only to the film. However, even in the configuration of applying a voltage to both the film and the pressure roller, the same effects can be expected, which can be described with reference to a potential difference between the voltages applied to the pressure roller and the film.

Example 6

Figure 8A:
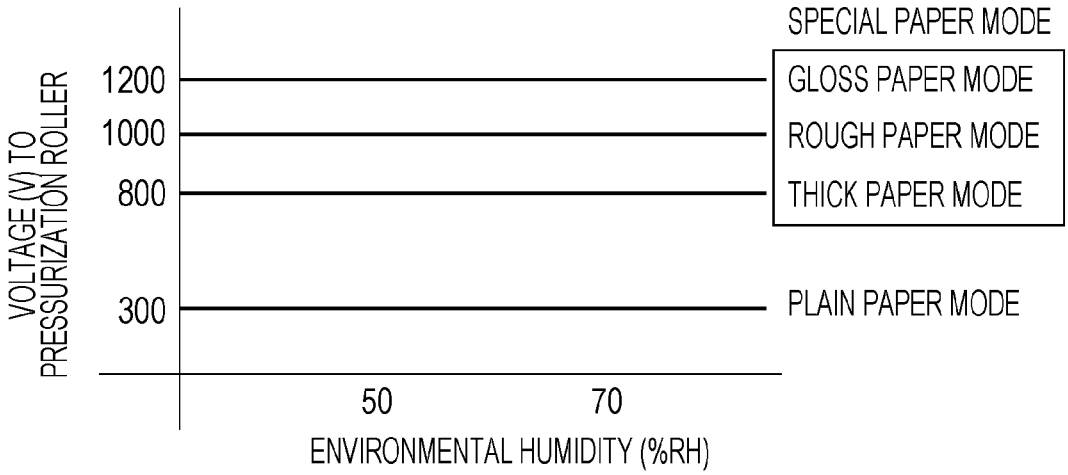
FIGS. 8A and 8B are views explaining Example 6 of the present invention.
Figure 8B:
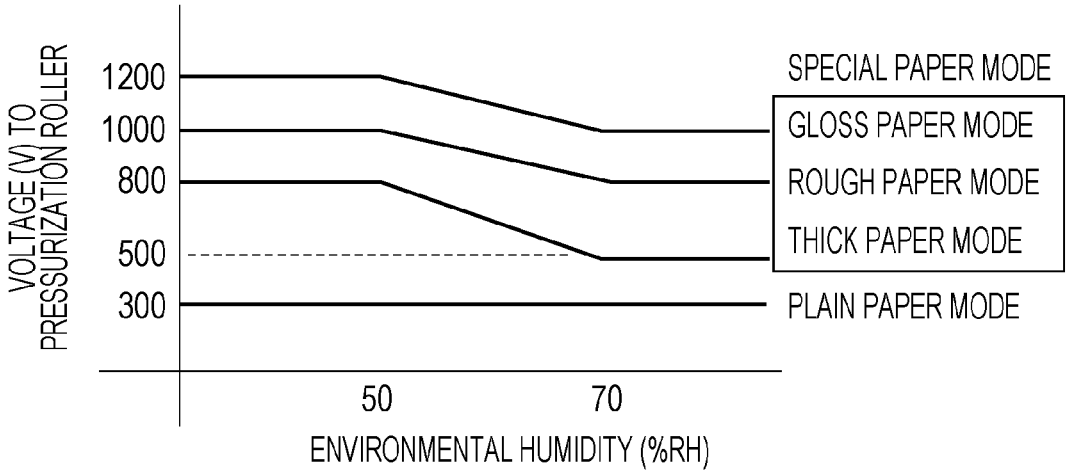

The details of the control in Example 6 are described with reference to FIGS. 8A and 8B. A fixing apparatus has the same configuration as the configuration of Example 4. As illustrated in FIG. 8A, Example 6 is an example in which the special paper mode is further divided into a plurality of modes according to paper types. Specifically, the modes include a thick paper mode, a rough paper mode, and a gloss paper mode. Depending on the characteristics of the paper types classified into these special paper types, a voltage of the pressure roller required for suppressing the separating offset varies in some cases. Therefore, the mode is divided according to each paper type and the voltage value is varied. By further dividing the special paper mode according to the paper type as described above, the drawing amount of paper dust can be suppressed to the lowest amount in a mode in which a voltage to be applied to the pressure roller can be even slightly reduced. For a paper type in the separating offset level is high, an improvement of an image can be preferentially aimed. In the special paper mode of FIG. 8A, the conveyance speed of the recording material was set to 110 mm/sec (half speed of the speed in the plain paper mode: 220 mm/sec) but is not limited thereto. For example, the speed can be further reduced to 70 mm/sec in the gloss paper mode, and then a voltage to the pressure roller suitable for the speed can also be applied. According to the member characteristics of the image forming apparatus or the fixing apparatus and the like, these special paper modes can be further divided and the conveyance speed and the voltage value to the pressure roller in each special paper mode can be individually set.

In FIG. 8A, an example of not varying the control value of the voltage to the humidity in the use environment is described. However, the control of varying the voltage to be applied according to the humidities of environments can also be performed as illustrated in FIG. 8B. This is one in which the voltage is varied corresponding to the ease of occurrence of the separating offset in each environment. In general, the moisture amount of the recording material decreases, and the resistance value increases in a low humidity environment. When the resistance value of the recording material increases, the transfer voltage in a transfer process becomes high, so that positive charges held in the recording material increases. Therefore, the separating offset level is likely to be worsened in the low humidity environment than in a high humidity environment. On the other hand, the separating offset becomes difficult to be noticeable in the high humidity environment, and therefore the required applied voltage to the pressure roller can be reduced in each sheet passing mode.

Comparative Example 1

Comparative Example 1 in Table 2 is an example in which the voltage to be applied to the pressure roller is controlled to be a high value of 1200 V also in the plain paper mode or also in the special paper mode in the configuration of Example 1. The separating offset did not occur but noticeable soiling occurred on the surface of the pressure roller in the plain paper mode.

Comparative Example 2

Comparative Example 2 in Table 2 is an example in which the voltage applied to the pressure roller is controlled to be a low value of 400 V also in the plain paper mode or also in the special paper mode in the configuration of Example 1. The pressure roller soiling level is a satisfactory level but noticeable separating offset occurred in the special paper mode.

Comparative Example 3

Figure 9:
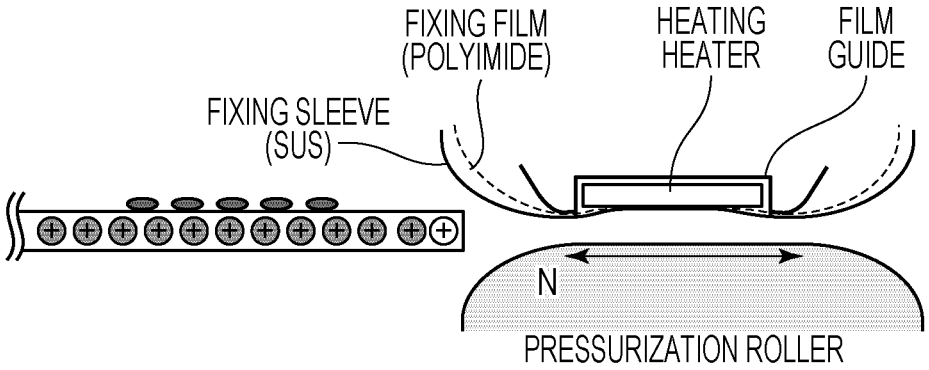
FIG. 9 is a view explaining Comparative Example 3 of the present invention.

Comparative Example 3 in Table 2 has a configuration in which the material used for the film base layer was changed to a stainless steel sleeve (SUS sleeve) from polyimide (PI) in the configuration of Example 1. Hereinafter, a film employing the SUS sleeve for the base layer is referred to as a fixing sleeve. The outer diameter is $\phi 18$ and the base layer thickness is 30.0 μm. In Comparative Example 3, the voltage value to be applied to the pressure roller in order to suppress the separating offset is higher than that of Example 1. A description is given with reference to FIG. 9. FIG. 9 illustrates a heater and a film guide member which holds the heater and regulates the travel of the film or the fixing sleeve. In the upstream and the downstream of the nip, the deformation of the film or the fixing sleeve is a bent shape with the contact portion with the film guide as the fulcrum as illustrated in FIG. 9. As compared with the film indicated by the dotted lines, the bent curve of the fixing sleeve indicated by the solid line becomes large. This is because the rigidity is higher in the fixing sleeve than in the film formed from resin. As compared with the film, the distance between the fixing sleeve and the paper becomes shorter when a sheet is passed at the same conveyance speed, and therefore the discharge start voltage also becomes low and the separating discharge occurs for a longer period of time, and therefore the number of the separating charges is larger than that of the film formed from resin. Therefore, the film employing polyimide resin for the base layer is more effective for the prevention of the separating offset than the fixing sleeve employing SUS for the base layer.

Comparative Example 4

Figure 10:
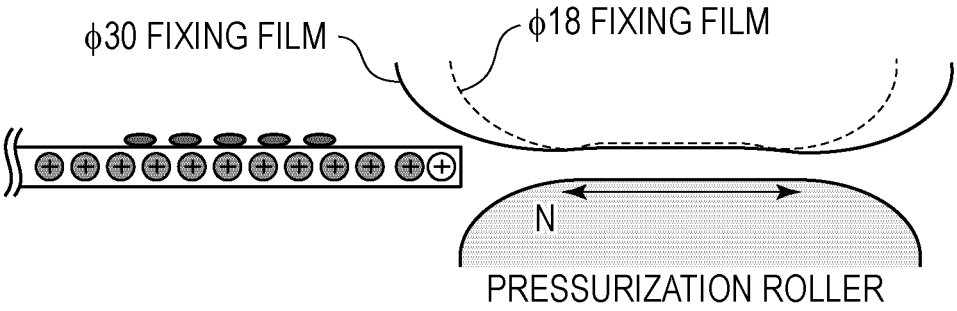
FIG. 10 is a view explaining Comparative Example 4 of the present invention.

In Comparative Example 4 in Table 2, the outer diameter of the film was changed to 30 mm from 18 mm in the configuration of Example 1. Comparative Example 4, the voltage value for suppressing separating offset is higher than the voltage value of Example 1. A description is given with reference to FIG. 10. In the film having an outer diameter of 30 mm indicated by the solid line, the radius of curvature at the downstream of the nip becomes larger than the radius of curvature of the film having an outer diameter of 18 mm indicated by the dotted lines. As compared with the film having an outer diameter of 18 mm, when a sheet is passed at the same conveyance speed, the distance from the sheet becomes shorter, and thus the discharge start voltage also becomes low. Moreover, since the separating discharge occurs for a longer period of time, the number of separating charges increases as compared with the film having an outer diameter of 18 mm. Therefore, the use of a film having a small diameter is more effective for suppressing the separating offset.

Other Application Examples of Embodiment

Application Example of Image Forming Apparatus

The embodiment is described using an image forming apparatus of forming a monochrome image. However, even when the embodiment is applied to, for example, a full color image forming apparatus which forms an image using a plurality of types of toner, the same effects can be expected.

Application Example of Fixing Apparatus

A fixing apparatus to which the present invention can be applied is not limited to the device of a film heat fixing system. Even in the case of a fixing apparatus of a heat roller system, the same effects can be expected.

Figure 11:
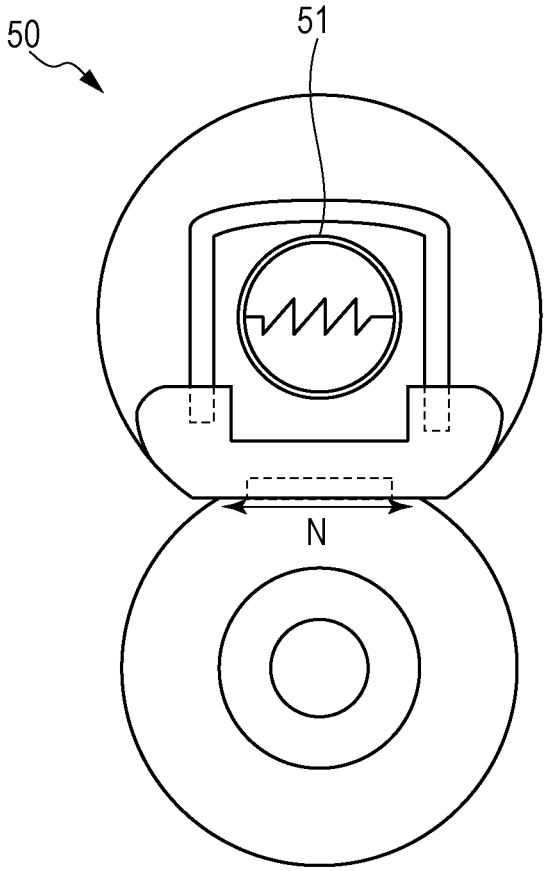
FIG. 11 is a schematic configuration diagram illustrating another heat fixing apparatus applicable to the present invention.

As a heat source of the film heat fixing system as illustrated in FIG. 11, a configuration in which a halogen lamp 51 is used in a film unit 50 may be acceptable. Other constituent members in FIG. 11 are the same as those of FIG. 2, and thus the description is omitted.

Furthermore, the same effects are obtained even when the base layers of the film and the fixing sleeve or some of layers forming the layer configuration of the fixing roller have a system of directly generating heat by electrification or an induction heating type fixing system.

TABLE 2

Table 2. Comparison of effects of Examples 1 to 5 and Comparative Examples 1 to 4

| | Configuration | | Plain paper mode | | | | Special paper mode | | | |
|---|---|---|---|---|---|---|---|---|---|---|
| | Film (Diameter/Base layer material/Top layer type) | Pressure roller (Diameter/Rubber material/Top layer type) | Sheet conveyance speed (mm/s) | Voltage value (V) | Separating offset | Pressure roller soiling | Sheet conveyance speed (mm/s) | Voltage value (V) | Separating offset | Pressure roller soiling |
| Example 1 | ϕ18/Electrically conductive PI/Insulation PFA | ϕ22/Electrically conductive solid/Insulation PFA | 220 | 400 | ○ | ○ | 110 | 1200 | ⊙ | ○ |
| Example 2 | ϕ18/Electrically conductive PI/Insulation PFA | ϕ22/Electrically conductive solid/Low charge PFA | 220 | 400 | ⊙ | ○ | 110 | 1100 | ⊙ | ○ |
| Example 3 | ϕ18/Electrically conductive PI/Low charge PFA | ϕ22/Electrically conductive solid/Low charge PFA | 220 | 300 | ⊙ | ⊙ | 110 | 900 | ⊙ | ⊙ |
| Example 4 | ϕ18/Carbon nanofiber-added PI/insulation PFA | ϕ22/Carbon nanofiber-added PI/Insulation PFA | 220 | 300 | ⊙ | ⊙ | 110 | 1000 | ⊙ | ⊙ |
| Example 5 | ϕ18/Electricallv conductive PI/Insulation PFA | ϕ22/Electrically conductive solid/Insulation PFA | 220 | Film side −400 | ○ | ○ | 110 | 1200 | ○ | ○ |
| Comparative Example 1 | ϕ18/Electrically conductive PI/Insulation PFA | ϕ22/Electrically conductive solid/Insulation PFA | 220 | 1200 | ⊙ | X | 110 | 1200 | ⊙ | ○ |
| Comparative Example 2 | ϕ18/Electrically conductive PI/Insulation PFA | ϕ22/Electrically conductive solid/Insulation PFA | 220 | 400 | ○ | ○ | 110 | 400 | X | ⊙ |

TABLE 2-continued

Table 2. Comparison of effects of Examples 1 to 5 and Comparative Examples 1 to 4

| | Configuration | | Plain paper mode | | | | Special paper mode | | | |
|---|---|---|---|---|---|---|---|---|---|---|
| | Film (Diameter/ Base layer material/Top layer type) | Pressure roller (Diameter/Rubber material/Top layer type) | Sheet conveyance speed (mm/s) | Voltage value (V) | Separating offset | Pressure roller soiling | Sheet conveyance speed (mm/s) | Voltage value (V) | Separating offset | Pressure roller soiling |
| Comparative Example 3 | ϕ18/SUS/Insulation PFA | ϕ22/Electrically conductive solid/ Insulation PFA | 220 | 500 | ○ | Δ | 110 | 1200 | ⊙ | ○ |
| Comparative Example 4 | ϕ30/Electrically conductive PI/Insulation PFA | ϕ22/Electrically conductive solid/ Insulation PFA | 220 | 500 | ○ | Δ | 110 | 1200 | ⊙ | ○ |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-015748, filed Jan. 29, 2015, which is hereby incorporated by reference herein in its entirety.

What is claimed is:

1. An image forming apparatus for forming a toner image on a recording material, comprising:

an image forming unit configured to form the toner image on the recording material;

a fixing unit configured to fix the toner image on the recording material while heating and conveying the recording material bearing the toner image at a nip portion, the fixing unit including a heating rotation member and a roller forming the nip portion with the heating rotation member; and a voltage applying unit configured to apply a voltage to produce a potential difference between a surface of the heating rotation member and a surface of the roller in such a manner that electrostatic force in a direction in which the toner of the toner image is held on the recording material occurs, wherein a plurality of print modes different in conveyance speed of the recording material at the nip portion are carried out, and wherein the voltage applying unit applies a voltage to produce the potential difference smaller in a first print mode than the potential difference in a second print mode in which the conveyance speed is lower than the conveyance speed of the first print mode.

2. The image forming apparatus according to claim 1, wherein the conveyance speed in the first print mode is set to a maximum speed settable in the apparatus, and the potential difference in the first print mode is set to be smaller than the potential difference in any print mode excluding the first print mode.

3. The image forming apparatus according to claim 1, wherein a basis weight of a recording material to be used in the first print mode is smaller than a basis weight of a recording material to be used in the second print mode.

4. The image forming apparatus according to claim 1, wherein smoothness of the recording material used in the first print mode is higher than smoothness of the recording material to be used in the second print mode.

5. The image forming apparatus according to claim 1, wherein the heating rotation member is a cylindrical film.

6. The image forming apparatus according to claim 5, wherein the fixing unit includes a heater contacting an inner surface of the film, and the heater forms a nip portion with a pressure roller through the film.

* * * * *